US005753331A

United States Patent [19]

Jeffrey

[11] Patent Number: 5,753,331

[45] Date of Patent: May 19, 1998

[54] POTTY TRAINING TOILET TISSUE

[76] Inventor: Margaret W. Jeffrey, 10719 Featherstone Dr., Fort Washington, Md. 20744

[21] Appl. No.: 714,800

[22] Filed: Sep. 13, 1996

[51] Int. Cl.[6] ..... B32B 3/02

[52] U.S. Cl. ..... 428/43; 428/195

[58] Field of Search ..... 428/43, 195; 242/1

[56] References Cited

U.S. PATENT DOCUMENTS 4,238,541 12/1980 Burton ..... 428/43

*Primary Examiner*—Alexander Thomas

[57] ABSTRACT

This invention provides a mechanism to train children in the proper amount of toilet tissue to use. The depiction of a symbol or color to designate the stop point on a roll of toilet tissue is the basis for the invention. Potty Training Toilet Tissue will mostly be used during the potty training stages. Adoption of this will result in reduced or elimination of waste as a result of a child pulling off too many sheets of toilet tissue. Using too much tissue is usually resultant of not knowing where to stop. This invention would meet that need. The method can easily be adopted in any presently manufactured toilet tissue and a high probability of use in any future manufactured toilet tissue.

1 Claim, 1 Drawing Sheet

POTTY TRAINING TOILET TISSUE

FIELD OF THE INVENTION

This invention provides a mechanism for training children to use the proper amount of toilet tissue when undergoing potty training. Adoption of this method will result in reduced or elimination of waste and cost avoidance. This method can be incorporated in any presently manufactured toilet tissue with a high probability of use in any future manufactured toilet tissue.

BACKGROUND OF THE INVENTION

This invention is put forth to assist parents and care givers in their efforts to train toddlers to use a specified amount of toilet tissue. When toddlers are trained in this regard, they can avoid excessive use of toilet tissue. This will result in waste avoidance.

This invention serves to address two issues confronting the consumers of our society today: (1) Environment: Waste products arriving at landfills across the country have reached phenomenal proportions. Recycling efforts have helped, but there is still plenty the average citizen can do to minimize waste. Citizens can accomplish this by using only the specified amount of a product that is required for the job. Excess toilet paper is frequently discarded in the bathroom waste receptacle. Using a specified amount of toilet tissue as delineated by the Potty Training Toilet Tissue will prevent this problem. (2) Consumer cost avoidance: First, toddlers training to use a certain amount of tissue will be beneficial for both the child and the parent. It can help the child by establishing a stop point or boundary, which children can easily grasp and understand that is the amount they need. Using this potty training toilet tissue can alleviate the uncertainty children experience when they pull the toilet tissue roll and it continues to roll. Now, the child will know when a certain point, or indicator, is reached and that this suggests to the toddler it is time to stop. Secondly, paper not discarded in the bathroom waster receptacle is discarded in the toilet. Potty Training Toilet Tissue helps the parent because it reduces the probability of an overflowing toilet from the child throwing too much tissue in the commode. Concurrently, this will reduce the parent's cost because the roll of tissue will last longer since waste is reduced or eliminated.

SUMMARY OF THE INVENTION

This invention is of an improved method of identifying and using a specified amount of toilet tissue during potty training toddlers. This method of toilet paper use is guided by the appearance of an ornamental design at designated points on a given roll of toilet tissue. The design will appear on the toilet paper at designated intervals of 0 to 101.6 cm (40 inches). Distance between intervals is paramount to this patent. The design will appear in a repetitive form on a roll of toilet tissue in close proximity to the lines of perforations and at an interval other than at every line of perforations. The design may appear before OR after regular perforation occurs on a roll of toilet tissue. This ornamental design will appear BOTH before and after the regular perforation occurs on a roll of tissue. The design will appear as symbols, characters, letters, numbers, straight breaking lines, straight non-breaking lines, irregular breaking lines, irregular non-breaking lines, and as a color line, including white. The design can move from left to right or from right to left. The design can be used together with all existing and future forms of toilet tissue. During manufacturing, it can be sprayed on the toilet tissue. The stop point indicator can also be fused into or woven into the tissue fiber.

BRIEF DESCRIPTION OF THE DRAWINGS

FIGS. 1–4 show isometric views of the toilet paper.

DESCRIPTION OF DRAWINGS

Figure 1:
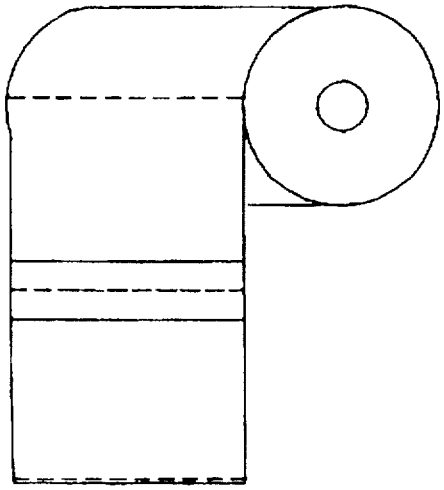
Figure 1A:
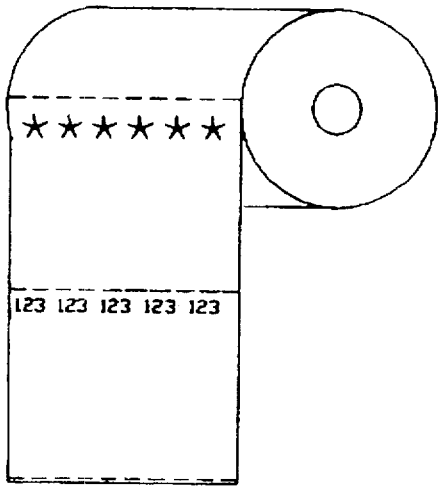
Figure 1B:
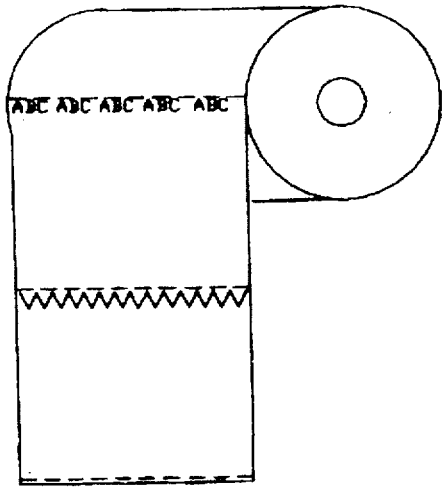
Figure 1C:
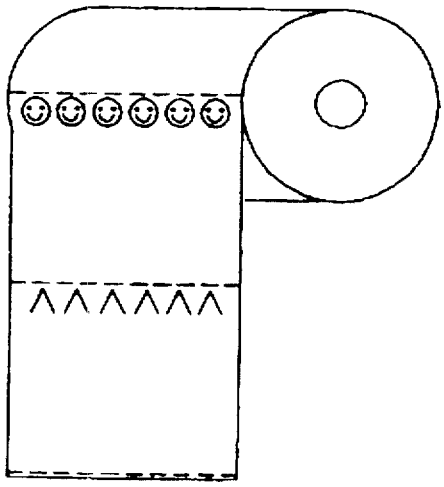

FIG. 1 depicts the drawing from a front view. This drawing demonstrates how a design will appear in reference to the perforation that is present on each roll of toilet tissue at designated intervals. The design can be placed on either side of the roll of tissue, depending on which would best suit manufacturing purposes or preferences. The result would be the same. The drawing symbols on the two succeeding pages numbered 1 through 14 are also representative of a plurality of patterns as they would appear on the roll of tissue at the perforation. The symbols are depicted in the two succeeding sheet to illustrate the infinite number of forms and appearances that could be used to indicate the stop point on a given roll of tissue. Doing so would indicate a stop point for a child who is potty training. This stop point method will be useful for some adults also.

I claim:

1. Toilet tissue for use in identifying and using a specified amount of toilet tissue while potty training small children comprising an elongated web of toilet tissue having a plurality of lines of perforations extending transversely across the tissue and designs on the toilet tissue in close proximity to the lines of perforations at a designated repetitive interval, other than at every line of perforations, to indicate a specific amount of toilet tissue to use.

* * * * *